United States Patent [19]

Saxton

[11] 4,118,902

[45] Oct. 10, 1978

[54] ANCHOR FOR FURNITURE INCLUDING TELEVISION SETS WITH TELESCOPIC INSERT ROD

[76] Inventor: Olivia Saxton, 2709 N. Keystone, Indianapolis, Ind. 46218

[21] Appl. No.: 771,455

[22] Filed: Feb. 24, 1977

[51] Int. Cl.[2] ..... E05B 73/00

[52] U.S. Cl. ..... 52/27; 70/58; 248/203

[58] Field of Search ..... 248/203; 70/57, 58, 70/14, 15, 18; 211/4, 7, 8, 9

[56] References Cited

U.S. PATENT DOCUMENTS

| | | | |
|---|---|---|---|
| 2,226,862 | 12/1940 | Hennessy | 70/15 |
| 3,664,163 | 5/1972 | Foote | 70/58 |
| 3,690,130 | 9/1972 | Eutzler | 211/4 |
| 3,756,048 | 9/1973 | Portus | 70/58 |
| 3,785,183 | 1/1974 | Sander | 70/58 |
| 4,005,973 | 11/1977 | Best | 70/58 |
| 4,057,982 | 11/1977 | Brayton | 70/14 |

*Primary Examiner*—John E. Murtagh

*Attorney, Agent, or Firm*—Woodard, Weikart, Emhardt & Naughton

[57] ABSTRACT

A theft-deterrent anchor for securing articles of furniture, including television sets. A rod having opposite ends with plates fixedly secured thereto is mounted within the article of furniture with the plates fixedly secured to opposite side walls of the article of furniture. A chain has a first end fixedly secured to the rod intermediate of the plates and extends outwardly of the article of furniture with the opposite end of the chain being fixedly secured to an anchor mounted to the floor or wall of the building.Various embodiments of the anchor are disclosed.

9 Claims, 5 Drawing Figures

ANCHOR FOR FURNITURE INCLUDING TELEVISION SETS WITH TELESCOPIC INSERT ROD

BACKGROUND OF THE INVENTION

1. Field of the Invention

This invention is in the field of furniture locks.

2. Description of the Prior Art

A variety of locks, anchors and other devices have been provided to prevent or reduce the opportunity of theft of many different types of furniture. For example, two of the more recent types of furniture anchors are shown in the U.S. Pat. Nos. 3,664,163 and 3,859,826. Another similar device is shown in U.S. Pat. No. 3,785,183. All three of these devices employ some type of tethering device with opposite ends attached to the protected item and a stationary object. Many of the prior art devices are relatively difficult to install, and in many cases, result in permanently injury to the protected article. The device disclosed herein is particularly advantageous in that minimum effort is required for the installation of the device.

Other devices of interest include a chain and lock combination attachable to a mat as shown in U.S. Pat. No. 274,788 and a spring and chain combination attachable to a chair for maintaining the chair in its original position as shown in U.S. Pat. No. 1,200,134.

SUMMARY OF THE INVENTION

One embodiment of the present invention is a retainer for an article of furniture comprising an anchor fixedly secured to a portion of a building, a chain having a first end and a second end with the first end fastened to the anchor, a rod with opposite ends and having the second end of the chain fixedly fastened thereto intermediate the opposite ends, and a pair of plates fixedly secured to the article of furniture.

It is an object of the present invention to provide a new and improved anti-theft anchor for an article of furniture.

It is a further object of the present invention to provide a new and improved retainer for an article of furniture.

Related objects and advantages of the present invention will be apparent from the following description.

DESCRIPTION OF THE PREFERRED EMBODIMENTS

Figure 1:
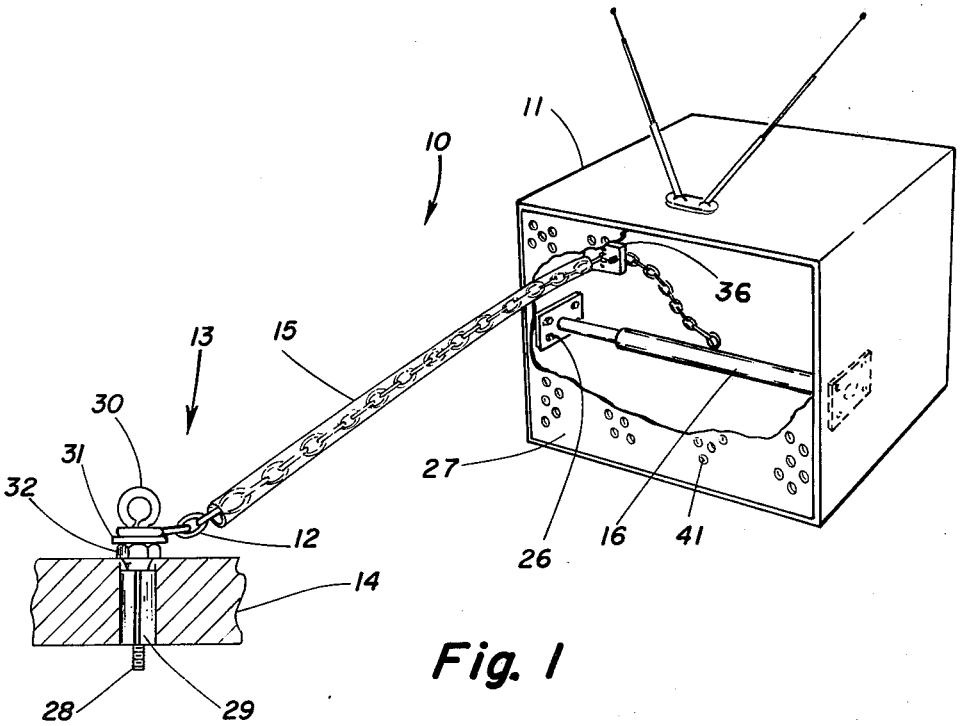
FIG. 1 is a fragmentary perspective view of an article of furniture attached to an anchoring device incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown the preferred embodiment of the anchoring device 10 incorporating the present invention. Anchoring device 10 is secured to an article of furniture 11, such as a television set. The anchoring device can be used with any article of furniture and including a variety of audio receivers such as television sets, and radios.

Anchoring device 10 includes a chain 12 having a first end attached to the article of furniture and a second opposite end attached to an anchor 13 mounted to the floor or wall 14 of a building. Chain 12 extends through a sheath 15 with the sheath extending from the article of furniture to anchor 13 to preclude accidental scratching of the furniture or the floor by the action of the chain rubbing against the furniture or floor. A rod 16 is fixedly attached to article 11 with the inner end of chain 12 attached to rod 16.

Figure 3:
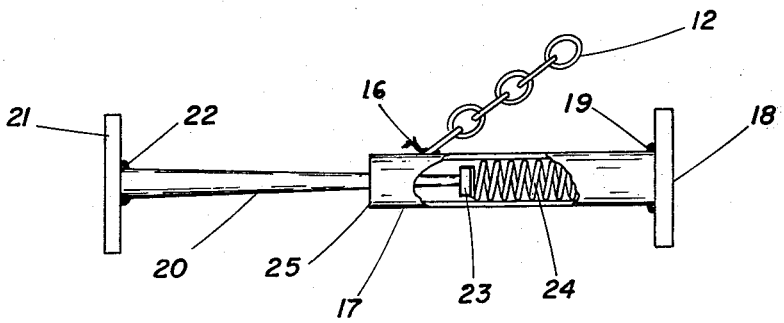
FIG. 3 is a fragmentary enlarged view of the telescopic rod shown in FIG. 1.

Rod 16 (FIG. 3) may be a single rod with opposite ends attached to the article of furniture or may be telescopically constructed so as to fit a variety of different sizes and shapes of furniture. For example, such a telescopic rod 16 is shown in FIG. 3 and includes a first hollow rod portion 17 having a plate 18 attached thereto by welds 19. Rod portion 17 slidably receives a second rod portion 20 having at its outer end a second plate 21 attached thereto by welds 22. Rod portion 20 extends into rod portion 17 and has an enlarged inner end 23 which prevents rod portion 20 from accidentally disengaging rod portion 17. End 25 is sized to allow rod portion 20 to slidably extend therethrough while preventing end 23 from passing through end 25. A helical spring 24 is positioned within rod portion 17 between end 23 and plate 18 so as to urge plates 18 and 21 apart. Thus, to install the anchoring device, plates 18 and 21 are urged together so as to allow the rod to be inserted into the article of furniture such as shown in FIG. 1. The helical spring then forces plates 18 and 21 outwardly adjacent the opposite side walls of article 11. Conventional fastening devices such as screws 26 (FIG. 1) then secure plates 18 and 21 to the opposite side walls of article 11. Chain 12 is welded to rod portion 17 with the chain then extending outwardly through the back wall 27 of article 11. Chain 12 continues to extend through sheath 15 to anchor 13 thereby securing article 11 to the building.

Figure 2:
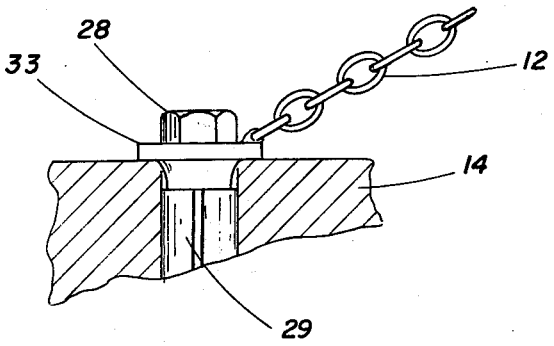
FIG. 2 is a fragmentary enlarged view of a portion of an alternate embodiment of the anchoring device.

Two different versions of anchor 13 are shown in FIGS. 1 and 2. In FIG. 1, a threaded member 28 extends into an expandable and internally-threaded cylinder 29 with threaded member 28 including a hook-shaped end 30 with a washer 31 and a hexagonal configured nut 32 positioned between wall 14 and the hook-shaped end 30. Threaded member 28 extends through chain 12 so as to position one link of the chain between washer 31 and the hook-shaped end 30. By tightening threaded member 28, the expandable cylinder 29 will expand and tightly grip wall 14 in a conventional well-known manner.

In FIG. 2, threaded member 28 is provided with a hexagonal-configured head in lieu of the hook-shaped end 30. Threaded member 28 extends into the same expandable cylinder 29 with a washer 33 being positioned between wall 14 and the head of threaded member 28. Chain 12 is then welded to washer 33.

Figure 4:
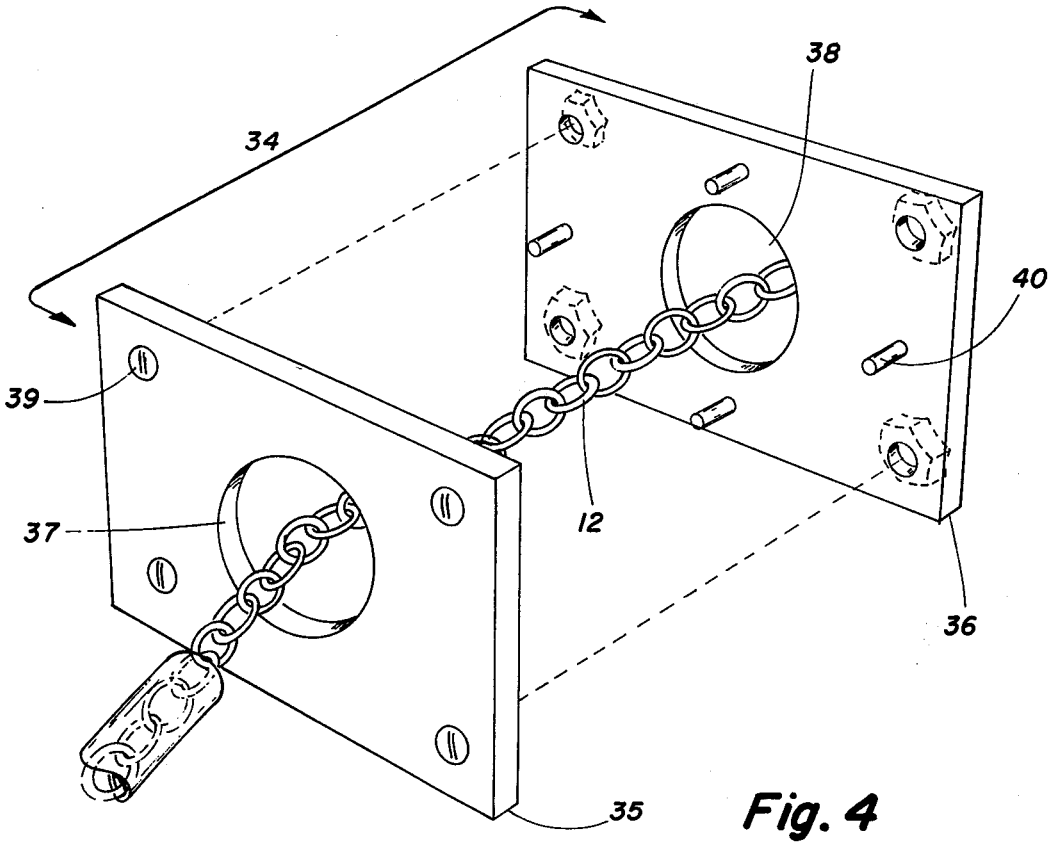
FIG. 4 is an exploded enlarged view of the plates secured to the back wall of the television set shown in FIG. 1 providing an access hole for the chain.

In order to prevent tearing of the thin back wall 27 of article 11, a pair of spaced-apart plates are provided on the back wall through which the chain extends. For example, chain 12 extends through wall protecting plates 34 (FIG. 4) which includes a pair of spaced-apart plates 35 and 36 both provided with apertures 37 and 38 through which chain 12 extends. Threaded fastening devices 39 fixedly secure plates 35 and 36 together with wall 27 extending between plates 35 and 36. A plurality of bosses 40 are fixedly secured to plate 36 and extend through apertures 41 normally provided in wall 27 to allow heat to escape from article 11. Bosses 40 abut the interior surface of plate 35 spacing the plates apart.

Figure 5:
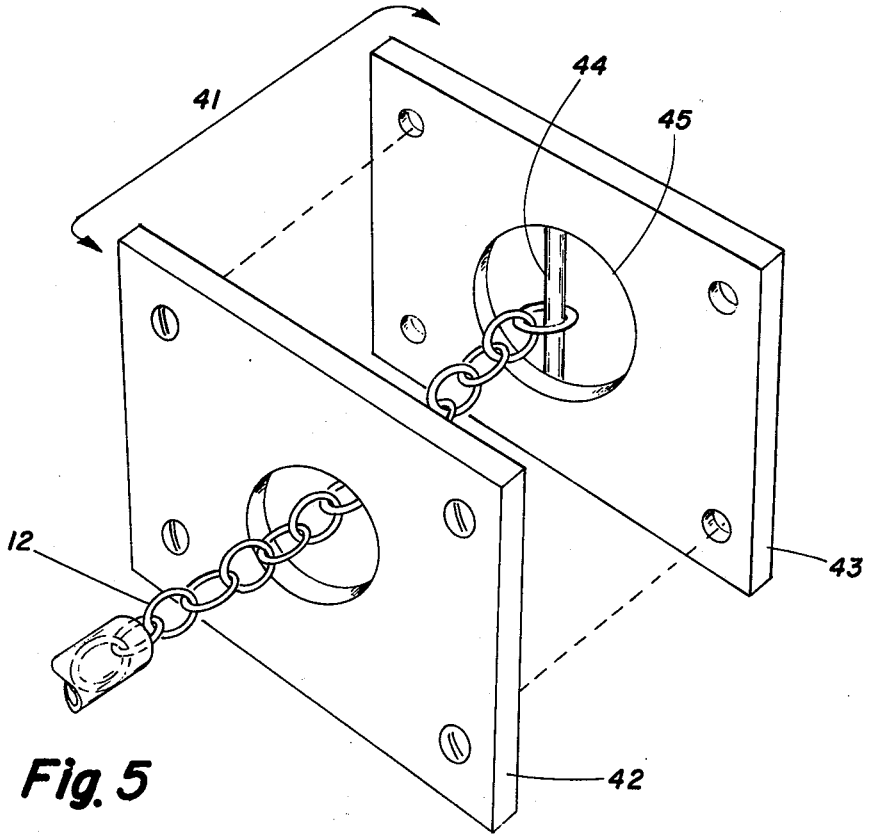
FIG. 5 is the same view as FIG. 4 only showing an alternate embodiment of the plates.

An alternate embodiment of the wall-protecting plates is shown in FIG. 5. Wall-protecting plates 41 include a pair of spaced-apart plates 42 and 43 identical to plates 35 and 36 with the exception that plate 43 is provided with a hole 45 across which pin 44 extends. Pin 44 is fixedly attached to plate 43 with the interior end of chain 12 being attached to pin 44. Thus, plates 42 and 43 are spaced apart and are attached to back wall 27 with the back wall extending between plates 42 and 43. Chain 12 terminates at plate 43 and therefore, rod 16 is not required in the event that the plates shown in FIG. 5 are utilized. In addition, plate 43 is not provided with bosses 40.

Many variations in the present invention are contemplated and included. For example, sheath 15 may be provided in a variety of colors depending upon the particular room furnishings. The anchoring device may be used with valuable furniture, including office furniture. The anchor may be installed either in the floor or into the vertical side wall of the building. It is anticipated that the chain should be approximately one and one-half feet long in the event the anchor is installed in the vertical wall whereas the chain should be approximately three feet long for a floor anchor. A relatively heavy-duty anchor should be used for attaching the chain to the floor whereas a smaller anchor may be used for a vertical wall.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A retainer for an article of furniture comprising:
an anchor fixedly secured to a portion of a building;
a chain having a first end and a second end with said first end fastened to said anchor;
a rod with opposite ends and having said second end of said chain fixedly fastened thereto intermediate said opposite ends; and,
a pair of plates fixedly secured to said article of furniture with said plates fixedly mounted respectively to said opposite ends of said rod.

2. The retainer of claim 1 and further comprising:
a pair of spaced-apart walls fixedly mounted to said article of furniture wiith said chain extending through at least one of said spaced-apart walls.

3. The retainer of claim 1 in combination with said article of furniture which is an audio receiver wherein said receiver has opposite side walls and a back wall, said rod extends between said opposite side walls with said plates affixed to said side walls, said chain extends through said back wall which is positioned between said pair of spaced-apart walls.

4. The retainer of claim 1 and further comprising:
a colored sheath through which said chain extends with said sheet extending from said article of furniture to said anchor.

5. The retainer of claim 1 wherein said anchor is inserted into the floor of said building.

6. The retainer of claim 3 wherein said back wall includes a plurality of apertures through which heat escapes;
said pair of spaced-apart walls include members extending through some of said apertures providing spacing between said pair of walls.

7. The retainer of claim 6 wherein said anchor includes a threaded bolt with an outer hook-configured end and a washer positioned between said end of said threaded bolt and said floor, said chain is attached to said threaded bolt between said washer and said end of said threaded bolt.

8. The retainer of claim 6 wherein:
said anchor includes a threaded bolt with a washer mounted thereon, said chain is welded to said washer.

9. The retainer of claim 1 wherein:
said rod is telescopic and includes a first rod portion slidably mounted to a second rod portion.

* * * * *